US005131499A

United States Patent [19]

Hoar

[11] Patent Number: 5,131,499

[45] Date of Patent: Jul. 21, 1992

[54] RETAIL STORE CHECKOUT DEVICE

[76] Inventor: Bruce E. Hoar, 1707 Church St., Holbrook, N.Y. 11741

[21] Appl. No.: 739,416

[22] Filed: Aug. 2, 1991

[51] Int. Cl.[5] ..... B65B 67/04

[52] U.S. Cl. ..... 186/66; 53/390; 248/97; 248/100

[58] Field of Search ..... 186/66, 67; 53/390; 248/97, 99, 100, 101

[56] References Cited

U.S. PATENT DOCUMENTS

| | | | |
|---|---|---|---|
| 1,580,163 | 4/1926 | Peterson et al. | 248/100 X |
| 2,324,596 | 7/1943 | Quain | 53/138.3 X |
| 3,628,632 | 12/1971 | Lambert | 186/66 |
| 3,721,063 | 3/1973 | Weimer | 53/390 |
| 4,062,170 | 12/1977 | Orem | 186/66 X |
| 4,305,558 | 12/1981 | Baker | 248/100 |
| 4,316,353 | 2/1982 | Suominen | 53/390 X |
| 4,389,834 | 6/1983 | Wysocki | 248/100 X |

FOREIGN PATENT DOCUMENTS

| | | | |
|---|---|---|---|
| 312062 | 6/1969 | Sweden | 186/66 |

*Primary Examiner*—F. J. Bartuska

[57] ABSTRACT

At a retail store checkout cashier or like station, rotary device which is delineated into circumferentially spaced compartments for successively storing plastic bags with handles, moving the handles of each bag in turn between supporting hooks to open each bag, and then filling the then open bag and removing the bag with its contents, all to the end of facilitating the customer checkout procedure.

1 Claim, 2 Drawing Sheets

RETAIL STORE CHECKOUT DEVICE

The present invention relates to improvements in a rotating carousel or compartmentalized device at a retail store checkout cash register or the like, and more particularly to the advantageous use of the carousel in conjunction with plastic bags with handle grips to facilitate the store checkout procedure.

EXAMPLES OF THE PRIOR ART

Rotary bag holders that theoretically could be used in the within intended manner are already known, as exemplified by those illustrated and described in U.S. Pat. No. 2,324,596 issued to Quain on Jul. 20, 1943, and in U.S. Pat. No. 3,721,063 issued to Weimer on Mar. 20, 1973. These and other known devices, however, do no more than rotate open bags, one at a time, into position for loading, after which they are rotated clear of the loading, after which they are rotated clear of the loading station. Moreover, and most significant, attachment and detachment of the bags being used is complicated and time consuming, and even costly in the construction material required of the bags.

In U.S. Pat. No. 4,305,558 issued to Baker on Dec. 15, 1981, more suitable bags for use at a checkout station or cash register is illustrated and described, but the manner of use, as best illustrated in FIG. 3 of this patent, is not suited to significantly facilitate the store checkout procedure.

Generally, it is an object of the present invention to overcome the foregoing and other short-comings of the prior art. More particularly, it is an object to use to advantage handle grips plastic bags in conjunction with an operational mode of a rotating carousel at a checkout station or cash register, to significantly speed and facilitate the store checkout procedure and provide other noteworthy benefits, as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
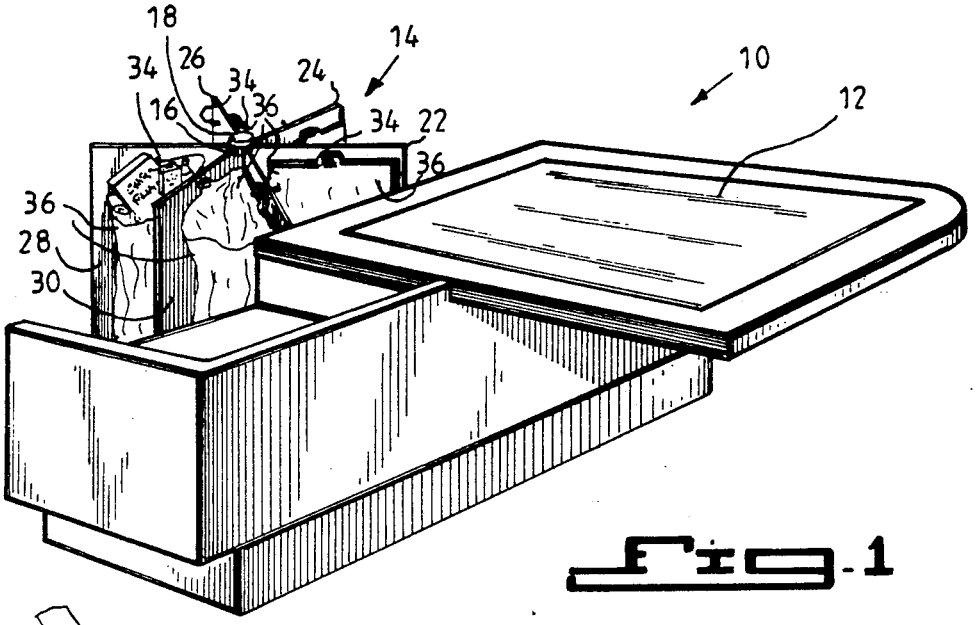
FIG. 1 illustrates the within inventive retail store checkout bagging procedure as practiced using handle grip bags and the within inventive bag preparation, filling and removal device shown in perspective orientation.
Figure 2:
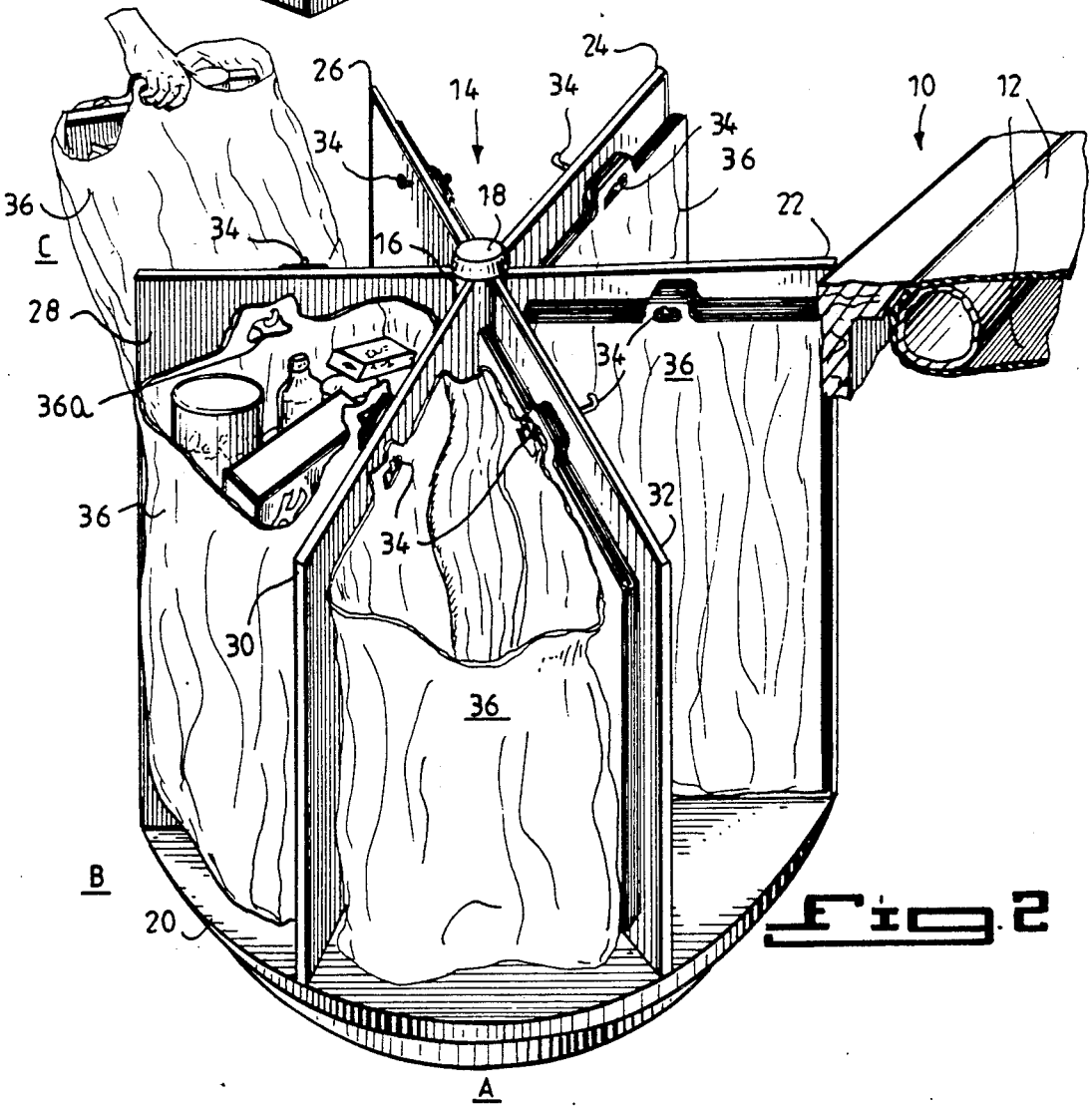
FIG. 2 is an enlarged scale perspective view of said device illustrating during a rotational traverse thereof a successively encountered bag-preparation station, bag-filling station and bag-removing station.

It is to be understood that shown in FIG. 1 is a typical food market checkout counter 10 of the type having a parcel conveyor 12 and having the operative relation illustrated in FIG. 1 with the rotational jounalled device or aptly named carousel structure of the present invention, the latter being generally designated by the reference numeral 14, and shown in greater detail in FIG. 2. More particularly, device 10 is rotational about the central vertical axis 16 mounted upright in a base member 20 (FIG. 3) and capped at 18.

In a preferred construction, device 14 is comprised of plural panels 22, 24, 26, 28, 30 and 32, or six in number in the illustrated embodiment, that are appropriately mounted in criss-crossing relation relative to the axis 16 so as to bound six triangular shaped compartments between adjacent halves of the panels that are in circumferential relation to each other about the axis 16. In each triangular compartment there is mounted in facing relation on the panels a pair of hooks 34 extending into the compartment.

Adapted to be used for the bagging procedure of the device 14 are plastic bags 36 of known construction in which opposite sides have aligned openings 36*a* (only one of which for simplicity is designated in FIG. 2) which serve as hand grips for the bags. At this point in the description, it is to be understood from FIG. 2 that along the rotational transverse or path of device 14 is a successively encountered bag-preparation station A, a bag-filling station B (at which there is designated the bag hand grip 36*a*), and a bag-removing station C.

The operational mode of the device 14 contemplates the placement of a select number of bags 36, suspended by the hand grips thereof, in advance of the bag-preparation station on only one hook 34. After a clockwise rotational advancement into the bag-preparation station A, a bag 34 (and each in turn thereafter) is prepared by having one hand grip 36*a* removed from the one hook 34 and placed on the other hook 34, so that the bag is suspended between the hooks 34 with the bag opening, of course, held open by the two hooks 34 of the compartment at station A.

The open bag 34 is then advanced from station A into the bag-filling station B, at which, as the name implies, the advanced bag is filled with purchased merchandise.

The next rotational traverse or advancement of the filled bag 34 is into a clearance location from the previously noted retail store checkout 10, which effectively serves as the bag-removing station C, at which, the bag hand grips 36*a* are removed from the cooperating supporting hooks 34, and the merchandise-filled bag 34 removed from the device 14, as illustrated in FIG. 2.

Figure 3:
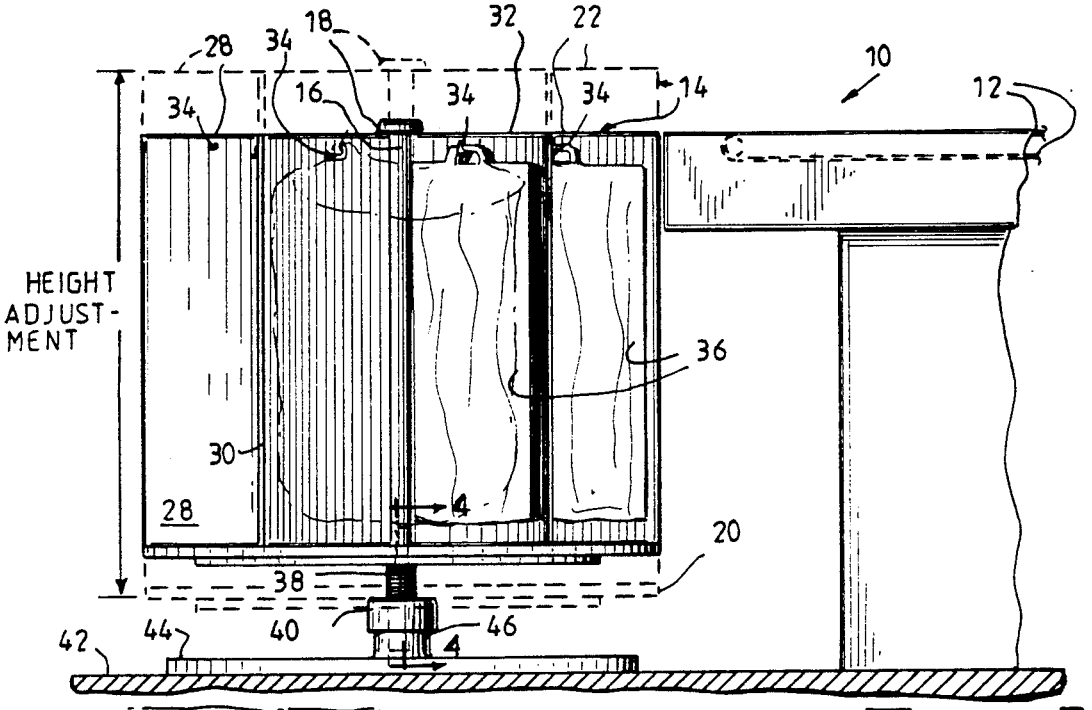
FIG. 3 is a side elevational view of the device more particularly illustrating the detailed structure which enables height adjustment thereof.
Figure 4:
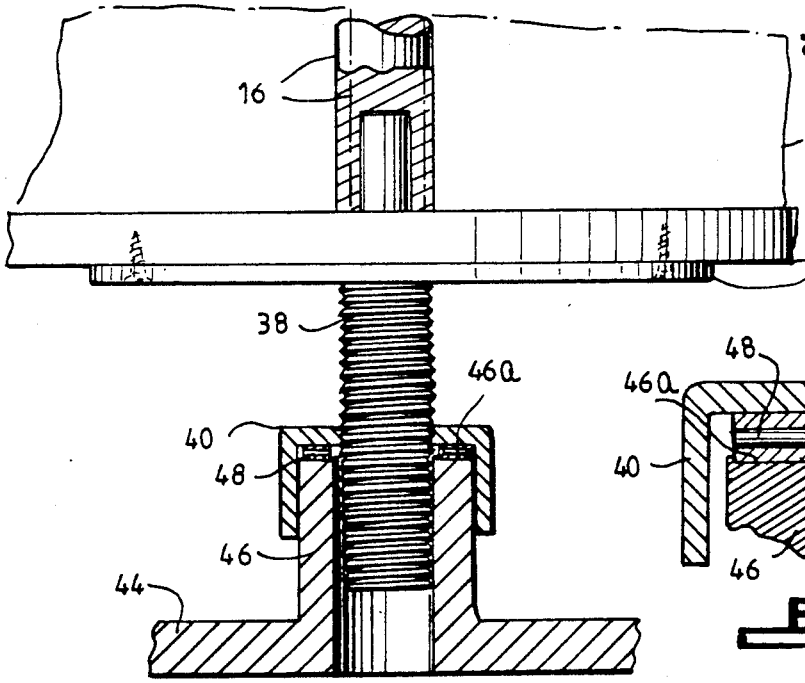
FIG. 4 is an enlarged sectional view as taken along the line 4—4 in FIG. 3, showing further structural details.
Figure 5:
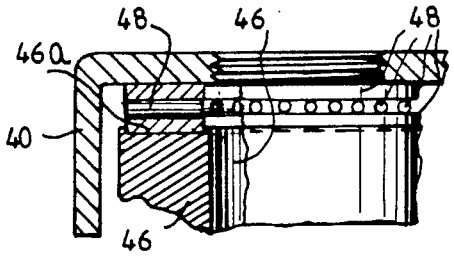
FIG. 5 is an enlarged sectional view taken of the structure within the circle 5 of FIG. 4 consisting of the bearing component of the rotating checkout device hereof.

To accommodate two different heights of checkout counters 12, the compartmentalized device or carousel 14 will be understood to be embodied with an appropriate means to make height adjustments in its mounted position on the rotational axis 16. For completeness, sake, and although no one such height adjustment means is essential to the within invention, the preferred means is best shown in FIGS. 3–5, to which reference should not be made, in which it is to be noted that the rotational axis is provided by the cylindrical support member 16 being rotatably mounted along with the base member 20 to which it is affixed, to a threaded spindle 38. A mating threaded collar 40 engages the spindle 38 and when held in a stationary position, that is when restrained against rotation, said collar will enable the threaded spindle 38 to travel in a vertical direction relative to the collar 40, thereby raising or lowering the height of the entire carousel structure 14 relative to a floor surface 42 to which the carousel structure and any adjacent checkout station 10 may be affixed.

As best seen in FIGS. 4 and 5, the collar 40 is supported above a mounting platform 44 that may be secured to the aforementioned floor surface 42, by means of a smooth bore socket 46. This socket extends upwardly a short distance above the upper surface of the mounting platform or base 44, and the smooth bore situated therein is accordingly adapted to receive therein the threaded spindle 38. To enable smooth operation of the carousel 14 during rotation, the upper surface of the socket 46 may be recessed, at a, to accommodate a plurality of roller bearings 48. Thus, the roller bearings 48 support from below the undersurface of the threaded collar 46, and when collar 46 is in its unrestrained mode, as when height adjustment has been completed, this will enable the entire carousel structure 14 and any loads supported thereon, to freely rotate relative to the axis 16 while being supported above the mounting platform or base 44.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. An improved retail store checkout device for facilitating the use of merchandise-containing bags of the type having aligned openings in opposite sides along the top edges of said sides to serve as hand grips, said checkout device comprising plural panels arranged in criss-crossing relation about a central vertical axis so as to bound triangular compartments between adjacent panels in circumferential relation about said vertical axis, in each triangular compartment a pair of hooks each mounted on a cooperating panel to extend into said compartment in facing relation to each other, and means journalling said compartment-defining panels for rotation about said vertical axis for providing an operational mode in relation to successively encountered bag-preparation station, bag-filling station and bag-removing station, a supply of plural bags being suspended by the hand grips thereof on a selected one of said hooks and at said bag-preparation station in successive turn one bag hand grip is removed from said one hook and suspended on said opposite hook to hold open the opening into said bag, at said bag-filling station purchased merchandise is placed into said opened bag, and at said bag-removal station said merchandised-filled bag is removed, whereby the rotational operational mode of said checkout device in conjunction with said bags facilitates the store checkout procedure.

* * * * *